US007571781B2

(12) United States Patent
Stoetzer

(10) Patent No.: US 7,571,781 B2
(45) Date of Patent: Aug. 11, 2009

(54) AUGER BIT

(75) Inventor: Erwin Stoetzer, Aichach (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 11/790,373

(22) Filed: Apr. 25, 2007

(65) Prior Publication Data

US 2008/0035385 A1 Feb. 14, 2008

(30) Foreign Application Priority Data

Apr. 26, 2006 (EP) ..... 06008686

(51) Int. Cl.
*E21B 10/00* (2006.01)

(52) U.S. Cl. ..... 175/413; 175/394; 37/189

(58) Field of Classification Search ..... 175/421, 175/394, 388, 18, 392, 412, 413; 408/227, 408/230, 229; 37/244, 257, 189; 172/25, 172/41, 35; D15/131, 132
See application file for complete search history.

(56) References Cited

U.S. PATENT DOCUMENTS

| | | | | |
|---|---|---|---|---|
| 569,121 | A * | 10/1896 | McLarty | 175/84 |
| 1,776,018 | A * | 9/1930 | Brown | 175/267 |
| 2,190,434 | A * | 2/1940 | Pivoto | 175/435 |
| 2,285,024 | A * | 6/1942 | Ferguson | 175/77 |
| 2,973,821 | A | 3/1961 | Stihl | |
| 3,763,942 | A | 10/1973 | Levitt | |
| 3,786,876 | A | 1/1974 | Aaltonen | |
| 4,252,481 | A * | 2/1981 | Krieg | 408/229 |
| 5,810,517 | A * | 9/1998 | Bostic | 407/53 |
| 6,082,472 | A * | 7/2000 | Verstraeten | 175/323 |
| 6,161,625 | A | 12/2000 | Mati | |
| 6,655,476 | B2 * | 12/2003 | Groce et al. | 175/316 |

FOREIGN PATENT DOCUMENTS

| | | |
|---|---|---|
| DE | 12 63 652 | 3/1968 |
| DE | 89 08 131 U1 | 10/1990 |
| EP | 1 580 397 | 9/2005 |
| WO | WO 98/41697 | 9/1998 |

* cited by examiner

*Primary Examiner*—David J Bagnell
*Assistant Examiner*—Cathleen R Hutchins
(74) *Attorney, Agent, or Firm*—Jacobson Holman PLLC

(57) ABSTRACT

The invention relates to an auger bit for an earth auger, in which at least two curved plates are provided and extend radially outwards from a drilling axis, the axial height decreasing radially outwards.

10 Claims, 3 Drawing Sheets

AUGER BIT

Figure 1:
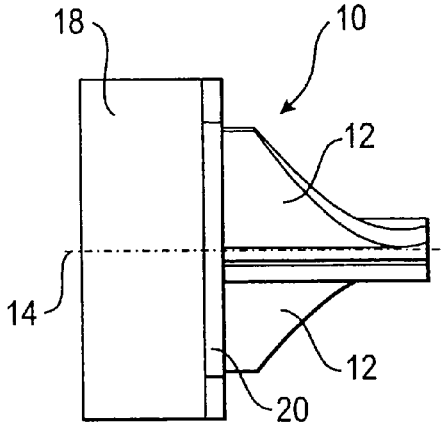

The invention relates to an auger bit for a ground or earth auger.

Such an auger bit is e.g. known from EP 1 580 397 A1. Auger bits are subject to considerable wear and consequently need frequent replacement. There are also drilling processes in which an auger bit is intended to remain in the ground. In such drilling methods with a so-called lost auger bit, on reaching a desired drilling depth they are released from a drill pipe, so that from the latter can flow out a hardenable suspension for installing or erecting a drilling pillar.

Therefore there is an interest in constructing such auger bits as inexpensively as possible, but with still good functionality, such as is necessary for a very run-free drilling in the ground. To this end EP 1 580 397 A1 discloses an auger bit made from simple sheet metal plates.

The object of the invention is to provide an auger bit which particularly adequately satisfies these requirements.

This object is achieved according to the invention by an auger bit having the features of claim 1. Preferred embodiments of the invention are given in the dependent claims.

An inventive auger bit for an earth auger is characterized in that at least two curved plates are provided, which extend radially outwards from a drilling axis and whose axial height decreases radially outwards. In the auger bit according to the invention the plates forming cutting helixes run radially outwards in turbine wheel-like manner from a central area on the drilling axis. This arcuate configuration with tapering towards the drilling axis permits a very good centring function of the auger bit. Simultaneously the use of simple, curved plates ensures inexpensive construction. The use of simple sheet metal parts makes possible an inexpensive welding construction, which is particularly advantageous for one-way use as a lost auger bit.

A particularly inexpensive variant of the invention is obtained in that the plates are provided with the same radius of curvature and are in particular segments of a cylindrical pipe. Thus, in simple manner the curved plates can be produced from inexpensive pipes. The arcuate curvature does not have to be separately produced by bending and instead arises in simple manner through the pipe radius.

For a good centring function it is advantageous according to the invention for the plates to have quarter circular arc-shaped segments with a triangular or trapezoidal contour. One edge of the plates can run parallel to the cylinder or bending axis and can be linear.

Basically, the curved plates can be directly adjacent to one another and welded to one another in the vicinity of the drilling axis of the auger bit to be formed. According to a preferred embodiment of the invention a central element is positioned coaxially to the drilling axis and the plates are adjacent thereto. The central element can be a bar made from steel or some other hard material. This central element can be used for increasing rigidity and for the precise positioning and reliable fixing of the curved plates. The central element can also have a tip, which projects axially with respect to the curved plates.

According to the invention a particularly good centring function is obtained through the provision of three or four plates arranged with a uniform, mutual angular spacing.

In the case of the auger bit according to the invention, preferably a pipe base body is provided for fitting to a drill pipe. It can e.g. be a short steel pipe section, which can be connected in a torque proofed manner with the drill pipe. The stability of the structure is further increased by the pipe base body on which can be provided a seal, particularly in an annular groove provided for this purpose, for sealing with respect to the drill pipe. The pipe base body can be inserted in or shoved over the drill pipe.

It is also advantageous according to the invention to provide a base plate on which the plates are located. To this end the curved plates have a planar edge with which same can be reliably welded to a planar base plate. However, it is also possible to directly weld the curved plates onto the pipe base body. However, for good sealing and high stability it is preferable to fix, more especially by welding the base plate with the fixed, curved plates to the pipe base body.

It is particularly appropriate according to the invention to provide on the pipe base body or base plate a positive locking device for a detachable connection to a drilling rod. They can be in the form of recesses, projecting bolts or edges, which for forming a bayonet catch can engage in correspondingly constructed positive locking elements on the drilling rod and can cooperate therewith.

According to the invention a good centring function is obtained in that the axes of curvature of the curved plates are parallel or inclined to the drilling axis. In this inclined arrangement the axes of curvature of the curved plates are tilted towards the drilling axis.

In the case of a drilling tool with a drilling rod, particularly a drill pipe, according to the invention on the drilling rod is provided an auger bit of the aforementioned type. Using such a drilling tool it is possible in a particularly reliable and inexpensive manner to erect a concrete element in the ground with a lost auger bit.

The invention is described in greater detail hereinafter relative to preferred embodiments shown in the attached diagrammatic drawings, wherein show:

FIG. 1 A first side view of an auger bit according to the invention.

Figure 2:
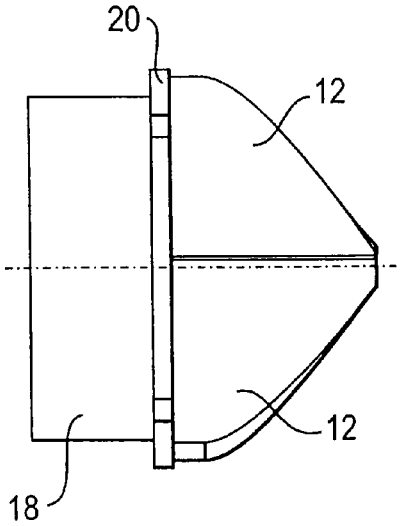

FIG. 2 A second side view of the auger bit of FIG. 1 turned by 90 ø.

Figure 3:
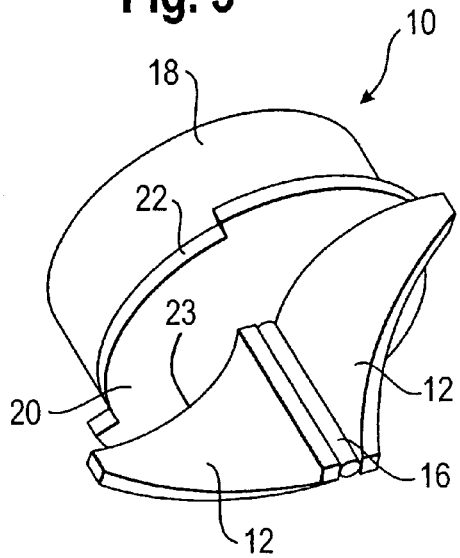

FIG. 3 A perspective view of the auger bit of FIG. 1.

Figure 4:
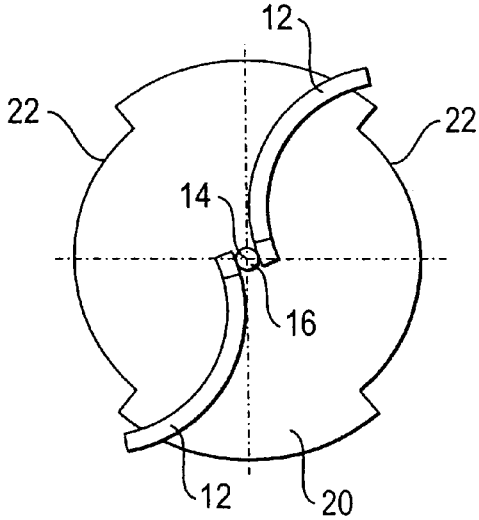

FIG. 4 A plan view of the auger bit of FIG. 1 from above.

Figure 5:
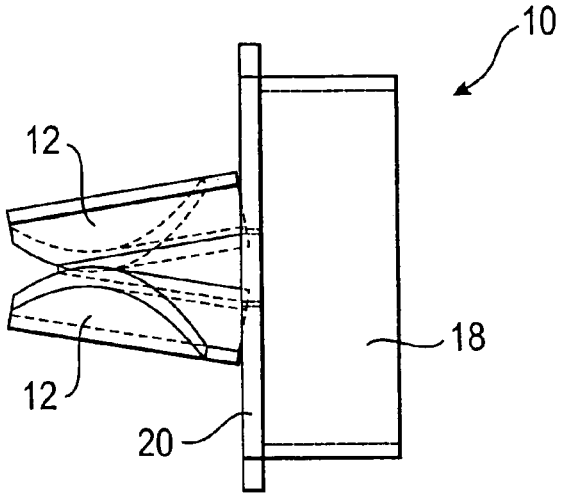

FIG. 5 A first side view of a further inventive auger bit.

Figure 6:
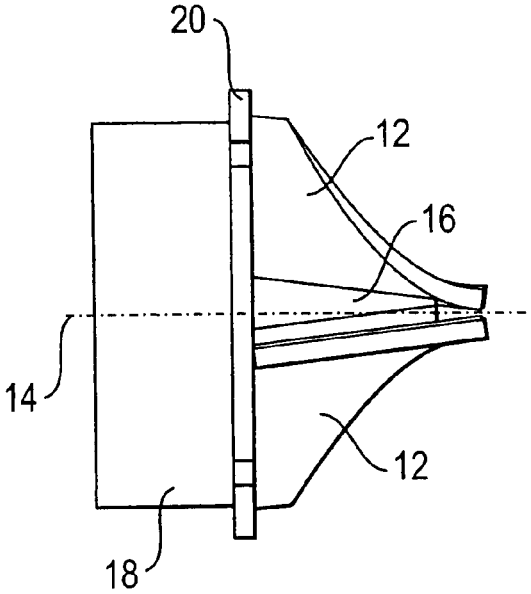

FIG. 6 A second side view of the auger bit of FIG. 5 turned by 90 ø.

Figure 7:
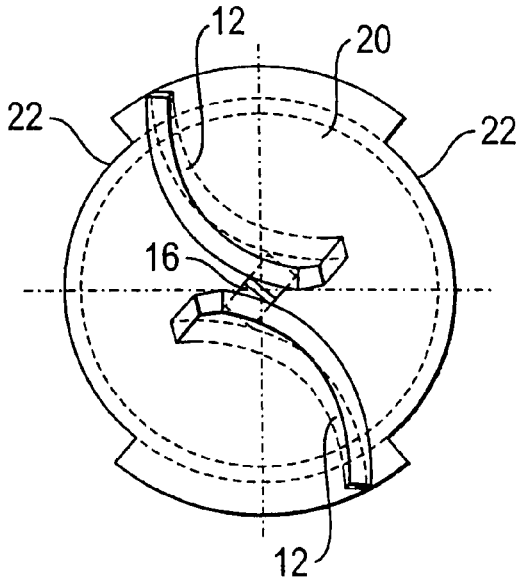

FIG. 7 A plan view of the auger bit of FIG. 5.

Figure 8:
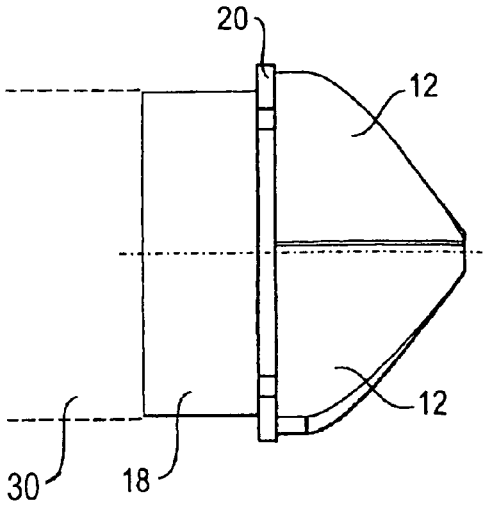

FIG. 8 A side view of the auger of FIG. 1 with the addition of a drilling rod in phantom.

Figure 9:
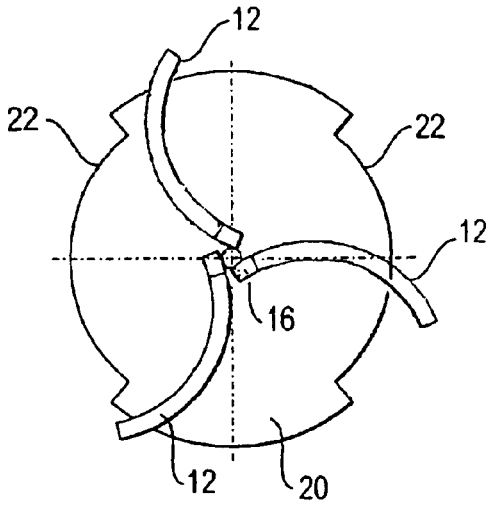

FIG. 9 A plan view of an auger according to the invention with three curved plates.

Figure 10:
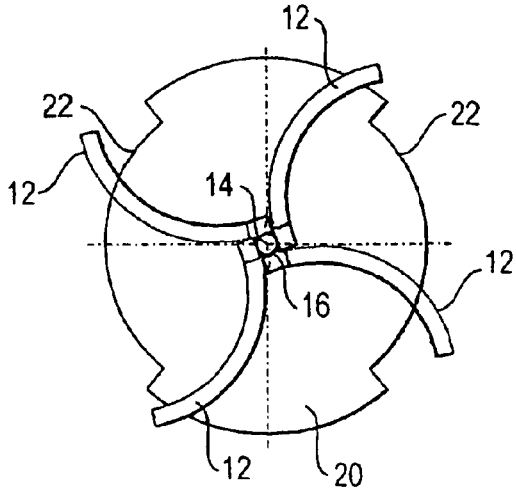

FIG. 10 A plan view of a modified version of the auger of FIG. 9 with four curved plates.

The embodiment of an inventive auger bit 10 according to FIGS. 1 to 4 comprises a pipe base body 18 closed at one end with a base plate 20. A cylindrical central element 16 which is flattened at its free end is placed coaxially to the central axis or drilling axis 14 on the planar base plate 20.

For forming cutting helixes two curved plates 12 are placed on base plate 20 and on central element 16. The two curved plates 12 have a trapezoidal contour, as can more particularly be gathered from FIG. 3. In the present embodiment the curved plates 12 are cut from a pipe as quarter circular arc-shaped segments, which permits a particularly inexpensive, stable design of plates 12 and are welded to the base plate by weld 23.

On central element 16 the plates 12 have an axial height corresponding to the length of said central element 16. The height of the plates decreases radially outwards, so that a desired pointed shape is produced. A marginal edge of the plates 12 forming a cutting edge runs roughly in part helical form, which is favourable for the centring and pointed function. This advantageous path results in simple manner from a straight cut, made with a skew angle, in a pipe from which the plates 12 are made.

Through the provision of the central element 16 the two plates 12 mutually displaced by 180 o are slightly offset with respect to the drilling axis 14, which leads to a desired, turbine-like path of the curved plates 12, as can be gathered from FIG. 4. The external diameter of the circular base plate 20 is greater than the external diameter of the hollow cylindrical pipe base body 18. Recesses are provided on two lateral areas of base plate 20 for forming a positive locking device 22. Said recesses are used for the detachable connection of the auger bit 10 to a drilling rod 30, particularly a hollow drill pipe. By means of the positive locking device 22, more particularly the radially projecting edges formed by the same, it is possible in simple manner to transmit the drilling torque from the drilling rod to the auger bit.

A further embodiment of an inventive auger bit 10 is shown in FIGS. 5 to 7. The pipe base body 18 and base plate 20 with the recesses as positive locking devices 22 are constructed in the same way as in the preceding embodiment. Whereas in the case of the previously described auger bit the axes of curvature of the curved plates 12 run parallel to the drilling axis, in the present embodiment of the auger bit 10 there is an inclined arrangement of the axes of curvature of the curved plates 12 towards the drilling axis 14. This makes it possible to achieve an arrangement of the curved plates 12 converging towards the drilling axis 14. Corresponding to this tapering arrangement, the central element 16 is constructed as a trapezoidal or a cross-sectionally roughly triangular body, which tapers from the base plate 20 towards the free tip. The actual free tip in the case of this auger bit 10 is formed by the upper edges of the curved plates 12. For the tilted arrangement of the curved plates 12 the latter are bevelled on the underside or, as shown in FIG. 5, recesses are provided in base plate 20.

The invention claimed is:

1. An auger bit for an earth auger having a drilling axis, the auger bit comprising:

a discrete planar base plate, at least two individual curved segments of a cylindrical pipe, each segment having a planar end and a cutting helix having a cutting edge, each segment extending radially outwards from the drilling axis and whose axial height decreases radially outwards, the at least two segments all having the same radius of curvatures, and the at least two segments having a constant thickness as they extend radially outwards, and a weld for separately fixing the planar end of each of the curved segments to the base plate.

2. The auger bit according to claim 1, wherein each segment is an approximately quarter circular arc-shaped segment with a triangular or trapezoidal contour.

3. The auger bit according to claim 1, wherein a central element is positioned coaxially to the drilling axis and the segments are adjacent thereto.

4. The auger bit according to claim 1, wherein there are three segments arranged with a uniform angular spacing to one another.

5. The auger bit according to claim 1, wherein each of the curved segments has an axis of curvature and the axes of curvature are arranged parallel or inclined to the drilling axis.

6. The auger bit according to claim 1 for use with a drilling rod, the auger bit further comprising a pipe base body connected to the base plate, the pipe base body being provided for fitting to the drilling rod.

7. The auger bit according to claim 6, further comprising a positive locking device for a detachable connection to the drilling rod provided on the pipe base body.

8. The auger bit according to claim 6, further comprising a positive locking device for a detachable connection to the drilling rod provided on the base plate.

9. Drilling device with a drilling rod wherein the drilling rod is provided with an auger bit according to claim 1.

10. The auger bit according to claim 1, wherein there are four segments arranged with a uniform angular spacing to one another.

* * * * *